US006550123B2

(12) United States Patent
Freeman

(10) Patent No.: US 6,550,123 B2
(45) Date of Patent: Apr. 22, 2003

(54) WIRE ROD FORMING PROCESS

(76) Inventor: Lionel Freeman, 2856 Colorado Ave., Santa Monica, CA (US) 90404

( * ) Notice: Subject to any disclaimer, the term of this patent is extended or adjusted under 35 U.S.C. 154(b) by 0 days.

(21) Appl. No.: 09/772,666

(22) Filed: Jan. 30, 2001

(65) Prior Publication Data

US 2002/0100157 A1 Aug. 1, 2002

(51) Int. Cl.[7] ..... A47G 1/20

(52) U.S. Cl. ..... 29/423; 29/452; 140/80; 156/247; 156/296; 24/304; 24/DIG. 11

(58) Field of Search ..... 29/423, 452, DIG. 3, 29/7; 140/80, 87, 71 R, 72; 72/363; 156/247, 296, 221, 297, 291; 24/304, DIG. 11, 16 R, 16 PB, 17 A, 17 AP, 17 R

(56) References Cited

U.S. PATENT DOCUMENTS

| | | | | | |
|---|---|---|---|---|---|
| 3,628,574 | A | * | 12/1971 | Ramseier | 140/72 |
| 3,719,538 | A | * | 3/1973 | Carlson et al. | 156/247 |
| 3,721,750 | A | * | 3/1973 | Countryman | 24/16 R |
| 4,471,819 | A | * | 9/1984 | Nihashi | 140/71 R |
| 4,477,301 | A | * | 10/1984 | Bouju et al. | 156/291 |
| 4,571,787 | A | * | 2/1986 | Furutsu | 24/16 PB |
| 6,185,791 | B1 | * | 2/2001 | Khokhar | 24/16 PB |

FOREIGN PATENT DOCUMENTS

| | | | | |
|---|---|---|---|---|
| JP | 003523149 | A1 | * 11/1986 | 140/111 |
| JP | 362270236 | A1 | * 11/1987 | 140/105 |
| JP | 363278625 | A1 | * 11/1988 | 140/105 |

OTHER PUBLICATIONS

Porth Products Company, "The Art of Bending," Port Products Company.

The U.S. Baird Corporation, "U.S. Baird Fourslide Machines,"U.S. Baird.

* cited by examiner

*Primary Examiner*—Gregory M. Vidovich
*Assistant Examiner*—Jermie E. Cozart
(74) *Attorney, Agent, or Firm*—Sanford Astor

(57) ABSTRACT

A process comprising taking a plurality of wire rods, laying them out together, side-by-side, ganging them together with a strapping means to form a flat, rectangular shaped array or panel, placing the array into a metal forming press and bending one end of all of the rods together, uniformly and simultaneously. The bound array can then be rotated 180 degrees, if desired, and the other end of the panel inserted to bend that end of all the rods, uniformly and simultaneously.

21 Claims, 2 Drawing Sheets

FIG. 1
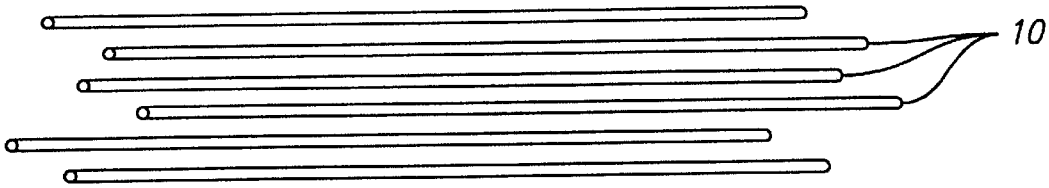
FIG. 2
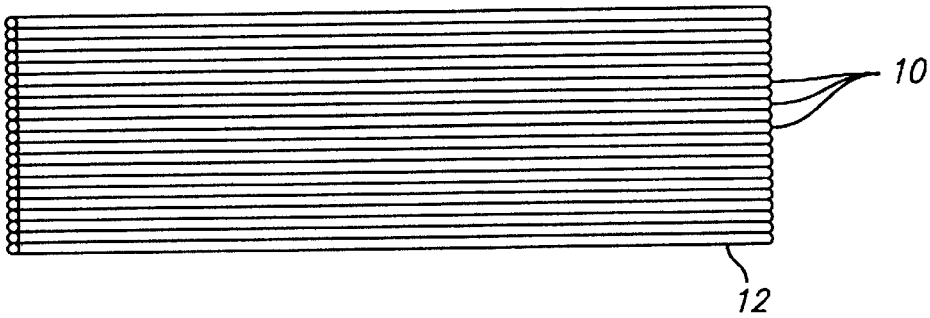
FIG. 3
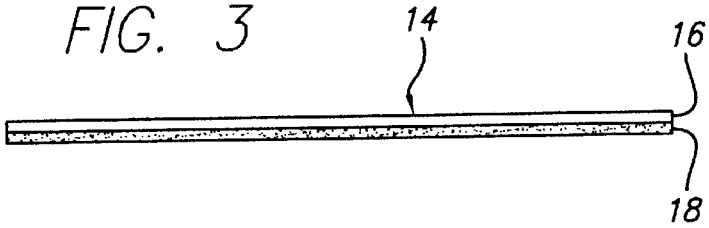
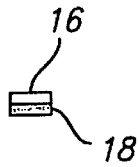
FIG. 4
FIG. 5
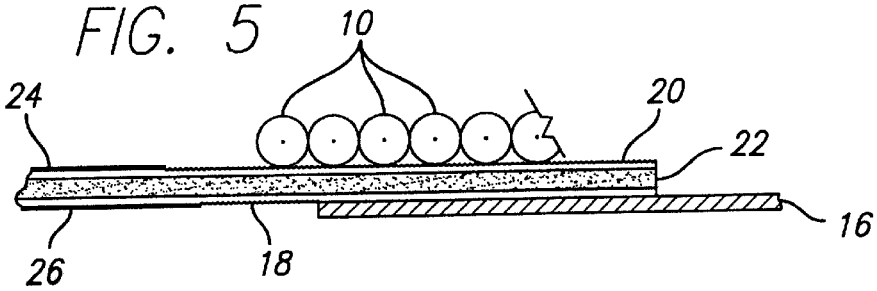

WIRE ROD FORMING PROCESS

This invention is described in my Disclosure Document #472468 filed Apr. 12, 2000.

BACKGROUND OF THE INVENTION

Wire hook-end rods, commonly referred to as double-hooks are used for a variety of purposes, such as the hanging of signs and other objects. They are made today by two methods, one of which is to take one straight wire rod, place the rod into a hand wire forming machine, bend one end into a curved shape, then take the rod out of the forming machine, turn it around, put the other end of the rod into the machine and bend that end into a curved shape. This process is slow and cumbersome and requires many man-hours to form any significant number of wire hooks. The other present method is to take a continuous coil of wire and feed it into a Four Slide machine, where the hooks are formed in the machine, one at a time. This method is also slow and cumbersome because only one hook-end rod is formed at a time and the hook-end wire rods come out loose and unpackaged.

SUMMARY OF THE INVENTION

Applicant's invention comprises taking a plurality of rods, laying them out together, side-by-side, ganging them together with a strapping means to form a flat, rectangular shaped array or panel, placing the array into a forming press and bending one end of all of the rods together, uniformly and simultaneously. The bound array can then be rotated 180 degrees, if desired, and the other end of the panel inserted to bend that end of all the rods, uniformly and simultaneously.

OBJECTS OF THE INVENTION

Accordingly, several objects and advantages of the invention are as follows:

It is an object of the present invention to provide a process for forming a pluality of formed wire rods, simultaneously.

Another object of the invention is to provide a process to quickly and economically form a plurality of wire rods, simultaneously, to save time and man-hours.

Yet another object of the invention is to provide a process to simultaneously form a plurality of double-hook wire rods, which can remain bound together until they are used, which provides convenience in shipping, handling, storage and use.

These, as well as other objects of the invention, will become obvious from the following description in which:

BRIEF DESCRIPTION OF THE DRAWINGS

FIG. 1 is a perspective view of a plurality of identical straight rods;

FIG. 2 is perspective view of a plurality of rods arranged in a flat, uniform rectangular array;

FIG. 3 is a side elevational view of a holding strap of this invention;

FIG. 4 is an end view of the holding strap of FIG. 3;

FIG. 5 is a cross-section, partially broken away, of the strap and a plurality of rods;

DETAILED DESCRIPTION OF THE INVENTION

Figure 7:
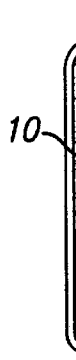
FIG. 7 is cross-section taken on lines 7—7 of FIG. 6.

Referring now to the drawings, there is shown in FIG. 1, a plurality of loose straight wire rods 10. FIG. 2 shows a plurality of rods 10 arranged together in a flat rectangular array or panel 12. FIGS. 3 and 4 show strap 14 which is a comprised of a bendable flat metal strap 16 to which is fixedly attached a permanent adhesive 18. Metal strap 16 may be made from any bendable metal, such as aluminum, steel, brass, copper, silver or other bendable metals. While two straps are shown, one, two or more straps may be used depending upon the length of the rods.

FIG. 5 shows the method of binding rods 10 with strap 14. Temporary adhesive 20 is bonded to a plastic or rubber foam substrate 22. Permanent adhesive 18 is bonded on one side to foam substrate 22 and on the other side to metal strap 16. Foam substrate 22, with adhesive 18 and 20 affixed, is a commercially available double sided foam tape, manufactured by 3M corporation. Rods 10 are arranged as flat rectangular array or panel 12 and strap 16, with temporary adhesive 20 is wrapped around panel 12 to hold panel 12 in position. The foam tape is superior to a simple double sided tape because it takes up the variances in tolerances of the rods, that is, as it passes around the curved edges of the rods it gives better contact with the rods.

The double sided foam tape comes with protective liners 24 and 26 on both sides, to prevent the tape from adhering to anything until it is to be used and the protective liners 24 and 26 are peeled off. First, protective liner 26 is removed and metal strap 16 is pemanently affixed to adhesive 18. Then liner 24 is removed and strap 16 with the temporary adhesive side 20 is bent and wrapped around array 12 to hold all of the rods tightly in place.

Figure 6:
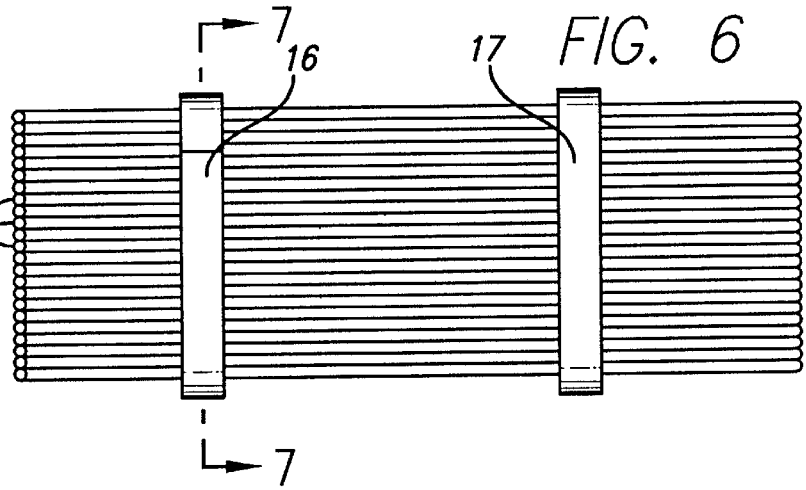
FIG. 6 is a top plan view of the strapped rods.
Figure 8:
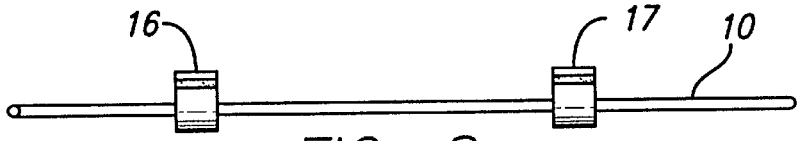
FIG. 8 is a side elevational view of the strapped rods.
Figure 9:
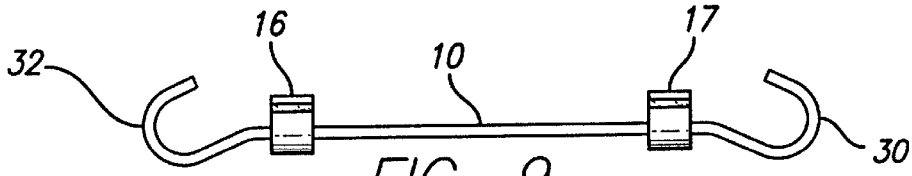
FIG. 9 is side elevational view of the strapped rods after bending.

FIGS. 6, 7 and 8 show rods 10 with two straps 16 and 17 wrapped around rectangular panel 12. Each end of panel 12 can then be simultaneously formed to the shape desired. FIG. 9 shows the same view as FIG. 8 after the bending of both ends of all rods 10 are completed, forming hooks 30 and 32. Hooks 30 are simultaneously formed on one end of all of rods 10 bound with straps 16 and 17. Strapped array 12 can then be turned 180 degrees and hooks 32 all formed simultaneously.

Figure 10:
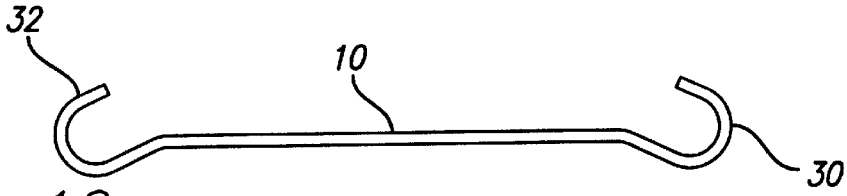
FIG. 10 is a side elevational view of one bent rod.
Figure 11:
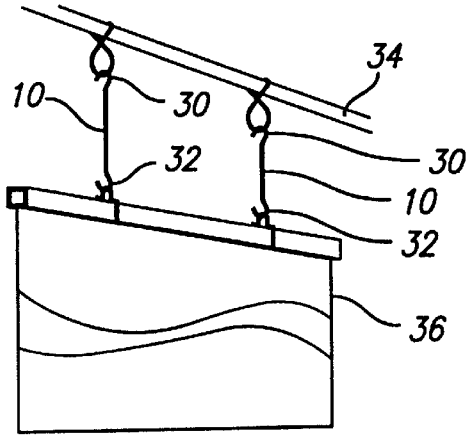
FIG. 11 is a perspective view of a use of the bent rods.

FIG. 10 shows one double hook rod 10 removed from panel 12, after straps 16 and 17 have been opened up. Each rod 10 can separately be removed by pulling it off of temporary adhesive 20, while the rest of rods 10 remain in array 12, held by temporary adhesive 20. FIG. 11 depicts one use for two double hook rods 10. One end of each rod 10 is hung from a ceiling or other overhead structure and the other end of each rod holds sign 36.

The length of rods 10 may vary from four inches to six feet or longer. The diameter of rods 10 may vary from 1/32 inch to 1/4 inch or more. The rods may be made of any bendable material such as aluminum, steel, brass, copper, silver, or other precious metals. From five to as many as fifty or more rods may be ganged together and formed in the manner described.

Although the specific embodiment of the invention has been described as double-hook rods, a hook may be formed on only one end if desired, or another shape may be formed on one or both ends of the rods, as desired. The forming machine may be any kind of radius bending equipment, such as a Diacro bender or a production wire forming machine, such as a Four Slide wire forming machine.

The strap wrapped around the plurality of rods does not have to overlap, as shown, but it is more secure if it does overlap.

The array of wire rod hooks bound by the straps is extremely convenient, since the rods are already packaged by the straps for shipping, handling, storage and use. When used by the consumer the wire rod hooks stay in position, remaining removably affixed to the adhesive on the straps and can be easily peeled off, one at a time, for use, while the others remain in place in the array, whereas today, the hooks are packaged all loose and jumbled and can become entangled. The method of this invention is significantly more econmical than hanging signs using cables or chains.

Having thus described the invention,

I claim:

1. A process for simultaneously forming and packaging for shipping a plurality of wire rods comprising, ganging the rods in a flat, uniform, rectangular array of rods, binding the array of rods with one or more straps which are removably affixed to the rods, said straps comprised of a bendable metal layer fixedly attached to one side of a permanent adhesive, one side of a substrate layer fixedly attached to the other side of the permanent adhesive and a temporary adhesive attached to the other side of the substrate, simultaneously forming the ends of all of the ganged, strapped rods with a metal forming machine.

2. The process of claim 1 comprising forming the ends of each rod into hooks.

3. The process of claim 1 comprising forming both ends of each rod into hooks.

4. The process of claim 1 comprising forming one end of all of the rods into hooks, rotating the panel one hundred eighty degrees and forming the other end of all of the rods into hooks.

5. The process of claim 1 in which the rod ends are formed using a high pressure forming press.

6. The process of claim 1 in which the strap is composed of aluminum, steel, brass, copper or silver.

7. The process of claim 1 in which the temporary adhesive is covered by a removable protective liner prior to use.

8. The process of claim 1 in which two or more straps are used to secure the array of rods.

9. A process for simultaneously forming a plurality of wire rods comprising, ganging the rods in a flat, uniform, rectangular panel, binding the rods with one or more straps which are removably affixed to the rods, the straps comprised of a bendable metal layer fixedly attached to one side of a permanent adhesive, one side of a substrate layer fixedly attached to the other side of the permanent adhesive and a temporary adhesive attached to the other side of the substrate, simultaneously forming one end of all of the ganged, strapped rods with a metal forming machine, rotating the panel one-hundred eighty degrees and simultaneously forming the other end of all of the rods.

10. The process of claim 9 comprising forming the ends of each rod into hooks.

11. The process of claim 9 comprising forming both ends of each rod into hooks.

12. The process of claim 9 in which the metal layer is composed of aluminum, steel, brass, copper or silver.

13. The process of claim 9 in which the temporary adhesive is covered by a removable protective liner prior to use.

14. The process of claim 9 in which two or more straps are used to secure the array of rods.

15. The process of claim 9 in which the adhesive layer is a double sided foam tape.

16. A process for simultaneously forming and packaging for shipping and sale to a user, a plurality of wire rods comprising, ganging the rods in a flat, uniform, rectangular panel of rods, binding the panel of rods with one or more straps which are removably affixed to the rods, the straps comprised of a bendable metal layer fixedly attached to one side of a permanent adhesive, one side of a substrate layer fixedly attached to the other side of the permanent adhesive and a temporary adhesive attached to the other side of the substrate, simultaneously forming one end of all of the ganged, strapped panel of rods with a metal forming machine, rotating the panel one-hundred eighty degrees and simultaneously forming the other end of all of the rods, said user peeling off one or more formed wire rods from said strapped panel, while the remaining rods remain removably attached to the temporary adhesive, for storage and future use.

17. The process of claim 16 comprising forming both ends of the panel of rods into hooks.

18. The process of claim 16 in which the metal layer is composed of aluminum, steel, brass, copper or silver.

19. The process of claim 16 in which the temporary adhesive is covered by a removable protective liner prior to use.

20. The process of claim 16 in which two or more straps are used to secure the panel of rods.

21. The process of claim 16 in which the adhesive layer is a double sided foam tape.

* * * * *